US008941038B2

(12) United States Patent
Geiger et al.

(10) Patent No.: US 8,941,038 B2
(45) Date of Patent: Jan. 27, 2015

(54) SUPPORT ASSEMBLY FOR SUPPORTING A HOUSEHOLD APPLIANCE IN A FREE-STANDING VERTICAL RELATION WITH ANOTHER HOUSEHOLD APPLIANCE

(75) Inventors: Joseph Geiger, Trent Woods, NC (US); Anthony Larsen, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 2166 days.

(21) Appl. No.: 11/703,567

(22) Filed: Feb. 6, 2007

(65) Prior Publication Data

US 2008/0185941 A1 Aug. 7, 2008

(51) Int. Cl.
*H05B 6/64* (2006.01)
*A47B 77/08* (2006.01)

(52) U.S. Cl.
CPC ..... *A47B 77/08* (2013.01); *H05B 6/6429* (2013.01)
USPC ..... 219/679; 219/678

(58) Field of Classification Search
USPC ..... 219/259, 402, 452.11, 678, 679, 756; 126/273 A, 27, 216, 215, 333, 299 R; 312/223.1, 293.1, 293.3; 29/700
See application file for complete search history.

(56) References Cited

U.S. PATENT DOCUMENTS

| | | | | | |
|---|---|---|---|---|---|
| T973,013 | I4 | * | 8/1978 | Ferrara et al. | 312/237 |
| 4,180,049 | A | * | 12/1979 | Carr et al. | 126/21 A |
| 4,354,084 | A | * | 10/1982 | Husslein et al. | 219/757 |
| 4,935,593 | A | * | 6/1990 | Nishikawa | 219/756 |
| 5,042,458 | A | * | 8/1991 | Spencer et al. | 126/299 R |
| 5,100,216 | A | * | 3/1992 | Enns | 312/263 |
| 5,957,557 | A | | 9/1999 | Langer et al. | |
| 6,166,353 | A | | 12/2000 | Senneville et al. | |
| 6,933,481 | B2 | * | 8/2005 | Greenburg | 219/679 |
| 2004/0065313 | A1 | * | 4/2004 | Thompson | 126/37 R |
| 2006/0151488 | A1 | * | 7/2006 | Ruffing et al. | 219/725 |

FOREIGN PATENT DOCUMENTS

| | | | | |
|---|---|---|---|---|
| GB | 2100978 A | * | 1/1983 | A47B 77/08 |
| KR | 2004057760 A | * | 7/2004 | |

* cited by examiner

*Primary Examiner* — Henry Yuen
*Assistant Examiner* — Hung D Nguyen
(74) *Attorney, Agent, or Firm* — James E. Howard; Andre Pallapies

(57) ABSTRACT

A support assembly is provided for supporting a household appliance such as a non-convection microwave oven in a free-standing vertical relation with another household appliance such that the non-convection microwave oven is supported above the other household appliance. The support assembly includes a base tray having a floor portion on which the non-convection microwave oven can be disposed, brackets for fixedly securing the base tray to the other household appliance, and a pair of bracket arms for securing a trim element to the base tray.

21 Claims, 4 Drawing Sheets

SUPPORT ASSEMBLY FOR SUPPORTING A HOUSEHOLD APPLIANCE IN A FREE-STANDING VERTICAL RELATION WITH ANOTHER HOUSEHOLD APPLIANCE

BACKGROUND OF THE INVENTION

The invention disclosed herein relates generally to a support assembly for supporting a household appliance in a free-standing vertical relation with another household appliance, and more particularly to a support assembly for a microwave oven.

Cooking appliances have been available, for example, in configurations known as built-in wall ovens and such ovens feature combination cooking. Combination cooking often involves the use of a microwave cooking source in addition to a thermal cooking source or thermal convection heat source. Using combination cooking can result in a significant decrease in cooking time while maintaining the same level of cooking performance with that of conventional cooking means. For example, a user may select to bake at 350.degree. and at the same time, microwave at 50% power level for 30 minutes. In this instance, the user has to select the mode (bake) and temperature (350.degree.), select the additional mode (microwave) and power level (50%) and the length of time to cook (30 minutes).

While built-in wall ovens can offer advantages as noted above, there are several factors to consider concerning the installation of built-in units. U.S. Pat. No. 5,957,557 notes that, in the kitchen area, appliances are installed either as upright units or, more widely, as built-in units. U.S. Pat. No. 5,957,557 further notes that appliances which are built in require extensive modifications to the wooden carcass and facings with front panels which match the other kitchen units. U.S. Pat. No. 5,957,557 further describes other perhaps detrimental aspects of such built-in units, including the fact that wood is sensitive to dampness and the effects of heat and the requirement to provide each appliance with its own power supply, often requiring installation to be carried out by a specialist electrician. Moreover, U.S. Pat. No. 5,957,557 notes that the electrical appliances of such built-in units are generally not stackable for static reasons.

U.S. Pat. No. 6,166,353 discloses a free-standing warming appliance 10 that can optionally be provided with a pair of oven support members 210 to directly support a built-in oven 14 and, in this respect, the free-standing warming appliance 10 and built-in oven 14 supported thereon may present one solution for installing a built-in unit. Each of the oven support members 210 is inverted-U-shaped in cross section and has inner walls that form a plurality of spaced-apart engagement arms 218 with mounting tabs 220 provided at their lower ends. The tabs 220 are sized to be inserted into a plurality of spaced-apart and collinear slots 222 formed in the top panel 76 of a warming drawer.

According to U.S. Pat. No. 6,166,353, each of its support members 210 is attached to the warmer drawer chassis 20 by inserting the tabs 220 into the slots 222 in the outer enclosure top panel 76 so that the arms 218 engage the top panel 76. Screws are then inserted to attach the outer wall 216 to the outer enclosure lateral walls 70, 72. It is readily apparent from the above description that the support members 210 can be installed and removed with access to only the lateral sides of the warming appliance 10. With each of the support members 210 attached to the warming appliance 10, the top walls 210 of the support members 210 are generally parallel and spaced-apart to form a generally horizontal support plane 223 for the built-in oven 14. As shown in FIG. 14 of U.S. Pat. No. 6,166,353, the oven 14 rests directly on the support member top walls 212 within a cabinet in a kitchen. Therefore, the free-standing warming appliance 10 directly supports the built-in oven 14.

Additionally, as shown in FIGS. 1 and 15 of U.S. Pat. No. 6,166,353, the free-standing warming appliance 10 can optionally be provided with a pair of cabinet support brackets 224. each having a generally planar main wall 226 and a tab 228 extending generally perpendicularly therefrom. The tabs 228 provide forward facing engagement surfaces that engage the rear surface of a cabinet front panel of a kitchen to prevent the chassis 20 of the warming appliance 10 from being pulled out of the cabinet 12 when the warmer drawer 22 is pulled out of the chassis 20.

While the arrangement disclosed in U.S. Pat. No. 6,166,353 may be effective for some installation scenarios concerning built-in units, there remains a need to provide, with respect to built-in units comprised of household appliances, an arrangement for facilitating installing of the various household appliances. Additionally, it would be desirable to have an arrangement that reinforces the stability already provided by a free-standing arrangement in which the various household appliances comprising the built-in unit are configured such that the entirety of built-in unit can support itself on a horizontal surface without recourse to support connections to other structures.

SUMMARY OF THE INVENTION

According to one aspect of the present invention, there is provided a support assembly for supporting a household appliance in a free-standing vertical relation with another household appliance such that the supported household appliance is supported above the other household appliance. The support assembly includes a base tray having a floor portion on which the supported household appliance can be disposed and means for fixedly securing the base tray to the other household appliance. The support assembly also includes means for securing a trim element to the base tray.

In accordance with further details of the one aspect of the present invention, the base tray includes walls defining a receiving space and the supported household appliance is a microwave oven that is received in the receiving space of the base tray. Additionally, the trim element includes an opening for permitting movement of a door of the microwave oven during opening and closing of the door.

In accordance with another aspect of the present invention, a support assembly is provided for a non-convection microwave oven and includes means for fixedly securing a base tray to another household appliance supports the base tray at a vertical spacing thereabove.

DETAILED DESCRIPTION OF THE INVENTION

Figure 1:
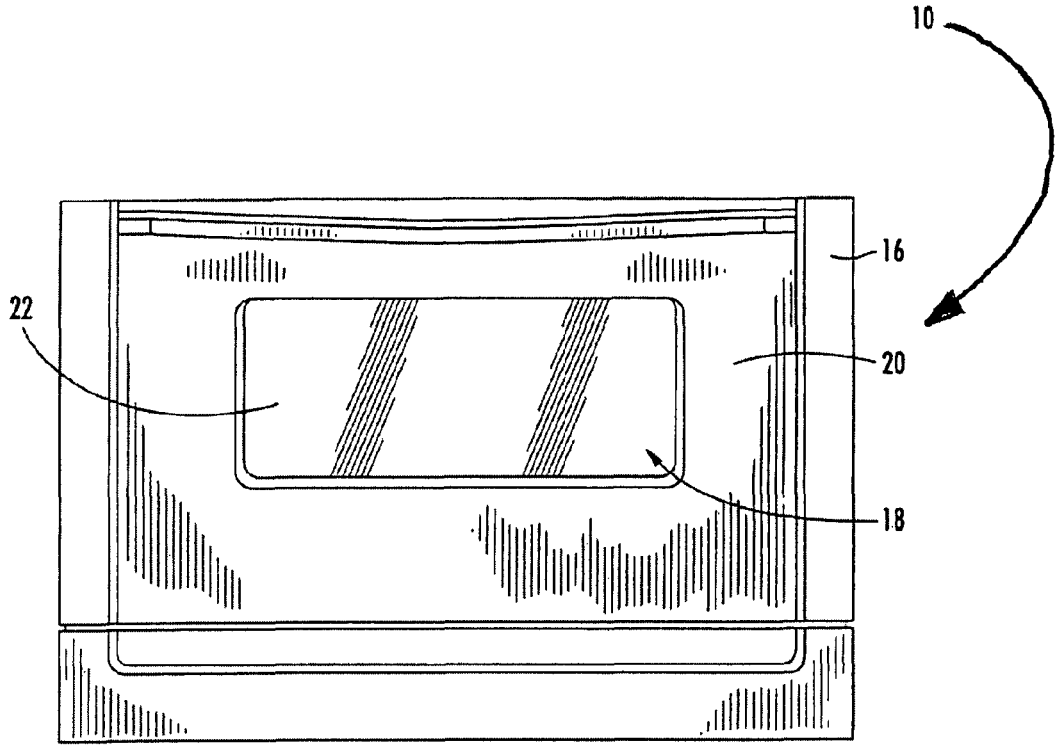
FIG. 1 is a perspective view of an oven.
Figure 2:
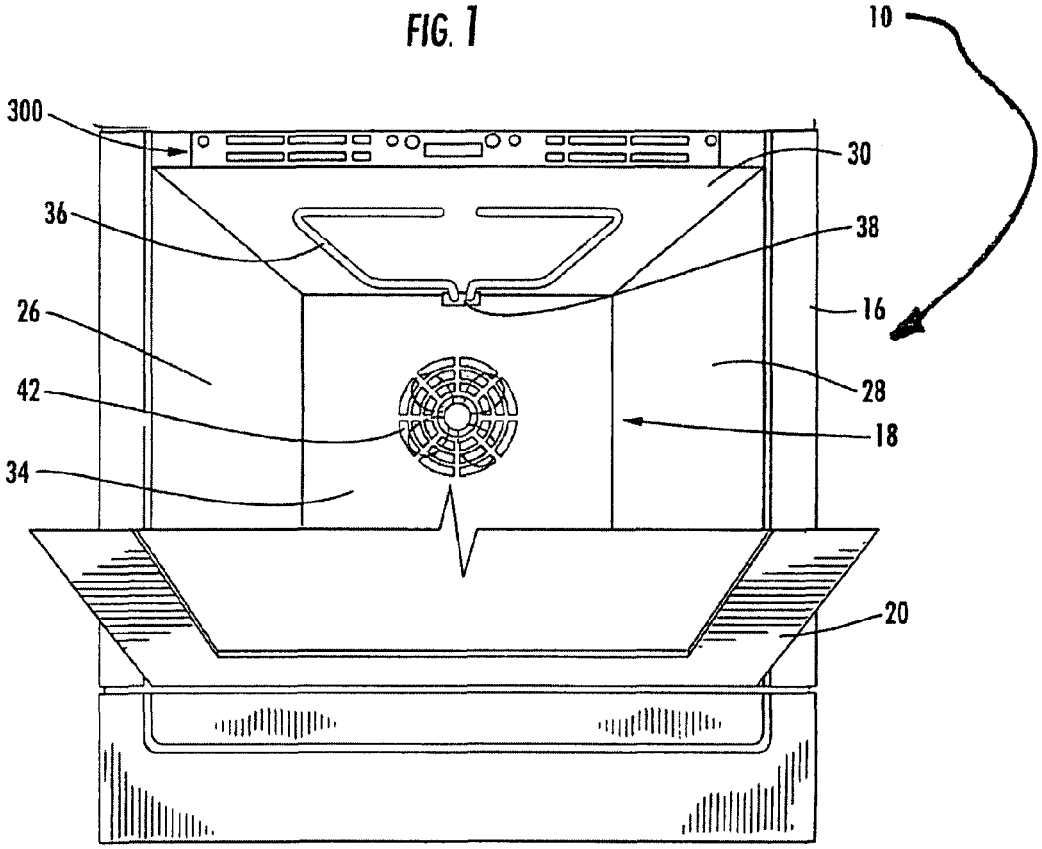
FIG. 2 is a front plan view of the oven of FIG. 1.

Referring now to FIGS. 1 and 2, an electric or gas oven or range 10 ("oven" is used for ease of reference hereinafter) is operable to cook and heat foodstuffs and other substances. Two units of the oven 10 can be arranged relative to one another to form a double oven combination and, additionally, such a double oven combination can be configured to be "built-in" double oven that is installed in a recessed manner in, for example, an area of a household—in other words, permanently secured relative to the household area and integrated with other elements of the household area to provide a consistent decorative appearance. Such a double oven combination may be comprised of two ovens each of which is a unit configured identically to the oven 10 described hereinabove with one of these ovens being an upper oven disposed at a predetermined spacing above the other oven (the lower oven) and can include an associated single control panel for controlling the operation of both the upper and lower ovens.

Continuing then with a description of the oven 10, the oven 10 can be operable as either an upper oven or a lower oven and includes a frame 16, with an oven cavity 18 closed by an oven door assembly 20. The oven door assembly 20 includes a window 22 for the user to view the inside of the oven cavity 18, such as to view food cooking in the oven cavity 18. The operation of the oven cavity 18 is controlled by the user utilizing an associated control panel. A self-cleaning operation of the oven cavity 18 is controlled by operation of the associated control panel.

With reference to FIG. 2, the oven cavity 18 generally has side walls 26 and 28, a top wall 30, a bottom wall 32, and a back wall 34. In the immediate vicinity of the top wall 30, where the oven is an electric oven, an interior or broil heating element (resistance coil) 36 can be disposed for grilling or broiling. The broil heating element 36 can be of any heating element known in the art and is in contact with a plug 38, for example, or another type of connecting element through its electrical terminals. In a gas oven, it is understood that gas burners within the oven cavity will be connected with a source of gas. An impeller or fan 42 can be located in the vicinity of back wall 34 for conducting air circulation within oven cavity 18.

Figure 3:
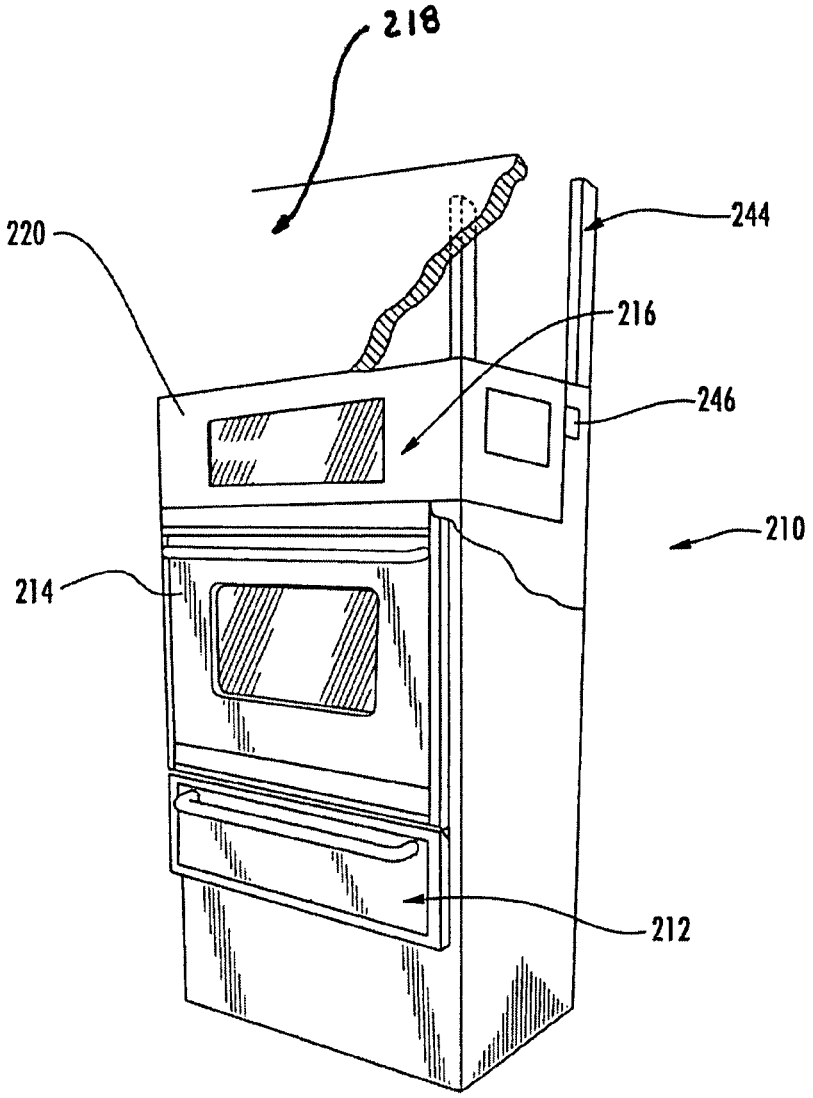
FIG. 3 is a perspective partial sectional view of a combination of household food preparation appliances installed as a built-in combination and an area of a household in which the built-in combination is installed.
Figure 4:
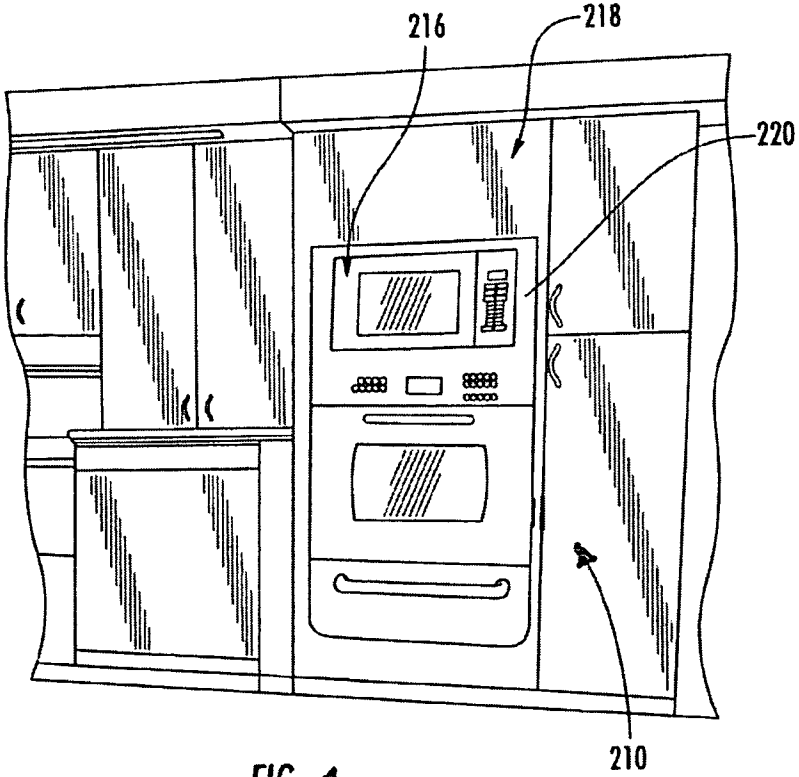
FIG. 4 is a perspective view of the built-in combination shown in FIG. 3 and showing portions of decorative elements of the household area.

Reference is now had to FIG. 3, which is a perspective partial sectional view of a combination of household food preparation appliances installed as a built-in combination and an area of a household in which the built-in combination is installed, and to FIG. 4, which is a perspective view of the built-in combination shown in FIG. 3 and showing portions of decorative elements of the household area. The oven 10 can be comprised as part of a combination of household food preparation appliances configured to be "built-in" an area of a household—in other words, permanently secured relative to the household area and integrated with other elements of the household area to provide a consistent decorative appearance. This combination of household food preparation appliances is hereinafter generally designated as the combination 210 and, solely for illustration purposes, the combination 210 is shown in FIG. 3 as having a warming drawer 212, a single oven 214, which itself may be configured as the oven 10 described herein above, and a microwave oven 216. Other configurations can be provided in lieu of this single oven-warming drawer-microwave oven combination. For example, a combination 210 may instead be comprised of a pair of ovens situated one above the other (a so-called "double oven" configuration) with a microwave oven above the double oven or, alternatively, the combination 210 may be comprised of a double oven and a warming drawer disposed intermediate the pair of ovens. The single oven 214 is a non-convection microwave oven in that it is an oven that cooks food and heats substances via radiant and convective heating powered by a non-microwave energy source.

As seen in FIG. 4, the combination 210 can be suitably attached to an appropriate mounting structure in, for example, a kitchen of a residential home or in another setting. In this regard, it is often desirable that the combination 210 is securely mounted in a recessed disposition, whereby the front panels or faces of the respective appliances such as the warming drawer 212, the oven 214, and the microwave oven 216 are substantially flush with the decorative panel, such as, for example, a decorative panel 218, of the room in which the appliances are disposed.

Figure 5:
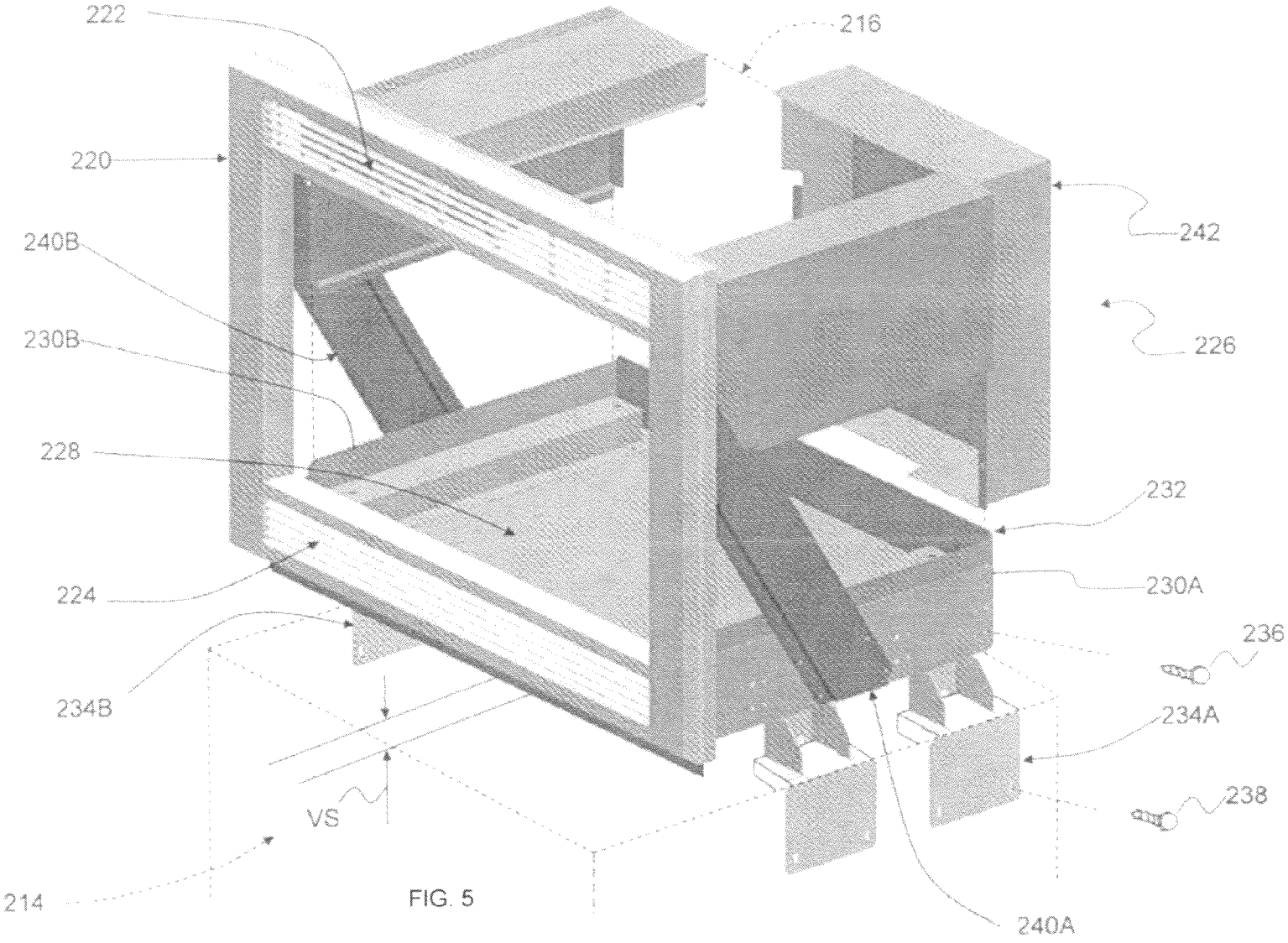
FIG. 5 is an enlarged perspective view in partial section of a portion of the built in combination shown in FIG. 3 and showing details of the one embodiment of the microwave oven support assembly of the present invention.

Reference is now had to FIG. 5, which is an enlarged perspective view in partial section of a portion of the built in combination shown in FIG. 3 and showing details of the one embodiment of the microwave oven support assembly of the present invention. It is often desirable to provide a trim piece to make the appearance of a household appliance consistent with the decorative appearance of the room such as, for example, a kitchen, in which the appliance is disposed. To this end, in connection with the disposition of the combination 210 in, for example, a kitchen, it may be desirable to provide a trim piece to achieve the consistent decorative appearance with the surrounding panel such as the decorative panel 218. Thus, as seen in FIG. 5, which is an enlarged perspective view of a portion of the combination 210 in which the microwave oven 216 is disposed, the combination 210 is preferably provided with a microwave oven trim piece 220. The microwave oven trim piece 220 is provided with an upper grille portion 222 and lower grille portion 224 each of which facilitates the passage of heated air from the surroundings of the microwave oven 216 outwardly into the kitchen. Additionally, the trim piece 220 is provided with a suitable decorative element appearance such as, as seen in FIG. 5, a beveled edge border appearance that is complementary to, or consistent with, the trim appearance of the oven 214 and the warming drawer 212 of the combination 210.

The microwave oven trim element 220 is disposed in an appropriate surrounding relationship to the front of the microwave oven 216 such that the door of the microwave oven 216 can be readily opened and closed, and the control panel of the microwave oven can be accessed, during normal operation of the microwave oven 216. In accordance with the present invention, a microwave oven support assembly 228 is provided for reliably and safely securing the microwave oven 216 relative to the remainder of the combination 210 and, as well, to ensure a proper mounting of the microwave oven 216 with respect to the kitchen or other room in which the combination 210 is disposed. In the preferred embodiment of the combination 210 described herein, the warming drawer 212, the oven 214, and the microwave oven 216 are mounted relative to one another such that these three components collectively form a free-standing structure with the oven 214 being directly fully supported on the warming drawer 212 and the microwave oven 216 being directly fully supported on the oven 214, whereupon it can be understood that, via this arrangement, the oven 214 and the microwave oven 216 are supported ultimately on the warming drawer 212. The warming drawer 212 itself may be directly supported on the floor of the kitchen or on a pedestal itself supported on the floor of the kitchen. Although the free-standing structure arrangement of the warming drawer 212, the oven 214, and the microwave oven 216 is configured to stably support these three components on a respective horizontal support surface such as a room floor or a pedestal itself supported on a room floor, suitable means are also provided for securing the warming drawer 212, the oven 214, or the microwave oven 216 to vertical support structures in the kitchen, such as, for example, vertical studs or joists. These vertical support securement means will be described in more detail hereinafter in connection with the following detailed description of the microwave oven support assembly 226.

The microwave oven support assembly 226 is an integral part of the free-standing structure arrangement of the warming drawer 212, the oven 214, and the microwave oven 216 and is specifically configured to enable the microwave oven 216 to be directly fully supported on the oven 214. As seen in FIG. 5, the microwave oven support assembly 226 includes a base tray 228 having a pair of opposed side walls 230A, 230B and a rear wall 232. The base tray 228 is compatibly configured with respect to the bottom of the microwave oven 216 for receiving the microwave oven 216 inserted into the volume defined between the pair of opposed side walls 230A, 230B and the rear wall 232 and resting upon a planar floor portion of the base tray 228. The base tray 228 is fixedly secured to a top portion of the oven 214 via a right hand bracket pair 234A and a left hand bracket pair 234B. Each of the right hand bracket pair 234A and the left hand bracket pair 234B is comprised of a pair of angled members each having an upper portion fixedly secured to the base tray 228 and a lower portion fixedly secured to the top portion of the oven 214. For example, the right hand bracket pair 234A includes a pair of angled members 236 each having an upper portion fixedly secured to the base tray 228 via sheet metal screws 236 and a lower portion fixedly secured to the top portion of the oven 214 via sheet metal screws 238. The right hand bracket pair 234A and the left hand bracket pair 234B support the base tray 228 above the oven 214 such that the planar floor portion of the base tray is horizontal and at a vertical spacing VS above the top of the oven 214

The microwave oven support assembly 226 also includes a pair of trim detail support arms 240A, 240B with each trim detail support arm 240A, 240B having one end thereof secured via rivets, screws, bolt-and nut, welding, or other suitable means to the base tray 228 and an opposite end secured to the trim piece 220. The detail support arms 240A, 240B fixedly mount the trim piece 220 to the base tray 228 with the trim piece 220 being supported in a generally vertical orientation parallel with the decorative panel 218 of the kitchen.

The microwave oven support assembly 226 additionally includes a surround brace assembly 242 having a plurality of brace arms connected to one another and to the base tray 228. These brace arms are positioned for contacting adjacent surfaces of the microwave oven 216 when the microwave oven 216 is mounted in the microwave oven support assembly 226 and are particularly positioned for contacting adjacent top side edges and top rear edges of the microwave oven 216 to thereby further ensure that the microwave oven 216 remains stably retained by the microwave oven support assembly 226.

As seen in FIG. 3, the microwave oven support assembly 226 can be secured via vertical support securement means to vertical support structures in the kitchen, such as, for example, vertical studs 244. The vertical support securement means are configured as attachment plates 246 fixedly secured to the microwave oven support assembly 226 and to the vertical studs 244. This arrangement reinforces the stability of the combination 210 already provided by the free-standing arrangement of the warming drawer 212, the oven 214, and the microwave oven 216 and provides further assurance that the combination 210 can resist tipping forces tending to tip the combination 210 outwardly from its installed position.

It will be understood that various details of the present invention may be changed without departing from the scope of the present invention. Furthermore, the foregoing description is for the purpose of illustration only, and not for the purpose of limitation, as the present invention is defined by the claims as set forth hereinafter.

What is claimed is:

1. A support assembly for supporting a household appliance in a free-standing vertical relation with another household appliance such that the supported household appliance is supported above the other household appliance, the support assembly comprising:

a base tray having a floor portion on which the supported household appliance can be disposed;

an assembly securing device configured to fixedly secure the base tray to the other household appliance; and a trim element securing device configured to secure a trim element having an opening to the base tray, the trim element securing device having a first trim attachment point configured to attach to the trim element on a first side of the opening and a second trim attachment point configured to attach to the trim element on a second side of the opening, the second side being on an opposite side of the opening from the first side, wherein the assembled support assembly including the base tray, the assembly securing device, and the trim element securing device is removable from the other household appliance as a single unit, and the base tray is configured to support the supported household appliance such that the supported household appliance is accessible through the trim element opening.

2. The support assembly according to claim 1, wherein the base tray includes walls defining a receiving space and the supported household appliance is a microwave oven that is received in the receiving space of the base tray.

3. The support assembly according to claim 2, further comprising the trim element, wherein the trim element includes an opening for permitting movement of a door of the microwave oven during opening and closing of the door, and the assembled support assembly including the base tray, the assembly securing device, the trim element securing device, and the trim element is removable from the other household appliance as a single unit.

4. The support assembly according to claim 3, wherein the trim element securing device includes a pair of bracket arms each having one end fixedly connected to the base tray and another end fixedly connected to the trim element, and the assembled support assembly including the base tray, the assembly securing device, the trim element securing device, the trim element, and the pair of bracket arms is removable from the other household appliance as a single unit.

5. The support assembly according to claim 4, wherein the assembly securing device includes a pair of angled members each having an upper portion fixedly secured to the base tray and a lower portion fixedly secured to the top portion of the other household appliance, and the assembled support assembly including the base tray, the assembly securing device, the trim element securing device, the trim element, the pair of bracket arms, and the pair of angled members is removable from the other household appliance as a single unit.

6. The support assembly according to claim 5, wherein the assembly securing device supports the base tray at a vertical spacing above the other household appliance.

7. A support assembly for supporting a first household appliance in a free-standing vertical relationship with a second household appliance such that the first household appliance is supported above the second household appliance, the support assembly comprising:

a base tray having a floor portion for supporting the first household appliance placed on the floor portion;

a tray attachment member fixedly secured to the base tray and for fixedly securing to the second household appliance; and a trim securing member for securing a trim element to the base tray, the trim element being trim for the first appliance and having an opening, the trim securing member having a first trim attachment point configured to attach to the trim element on a first side of the opening and a second trim attachment point configured to attach to the trim element on a second side of the opening, the second side being on an opposite side of the opening from the first side, wherein the tray attachment member is adapted to transfer the weight of the first household appliance to the second household appliance, and the base tray is configured to support the first household appliance such that the first household appliance is accessible through the trim element opening.

8. The assembly according to claim 7, wherein the base tray includes walls defining a receiving space for receiving the first household appliance.

9. The assembly according to claim 8, further comprising the trim element.

10. The assembly according to claim 9, wherein the trim element includes an opening for permitting movement of a door of the first household appliance during opening and closing of the door.

11. The assembly according to claim 10, wherein the floor portion of the base tray is vertically lower than an upper edge of a first part of the trim element, such that the first part of the trim element hides the floor portion from view when the first household appliance is in position on the floor portion.

12. The assembly according to claim 11, wherein the tray attachment member is adapted to support the base tray at a vertical spacing above the second household appliance.

13. The assembly according to claim 7, wherein the tray attachment member is adapted to support the base tray at a vertical spacing above the second household appliance.

14. The assembly according to claim 7, wherein the assembled support assembly including the base tray, the tray attachment member, and the trim securing member is removable from the second household appliance as a single unit.

15. An appliance assembly for placing in an enclosure in a household kitchen, the assembly comprising:

a first household appliance;

a second household appliance;

a trim element, the trim element being trim for the first appliance and having an opening through which the first household appliance is accessible;

a base tray having a floor portion that supports the first household appliance placed on the floor portion;

a tray attachment member fixedly secured to the base tray and fixedly securing to the second household appliance; and a trim securing member that secures the trim element to the base tray, the trim securing member having a first trim attachment point attached to the trim element on a first side of the opening and a second trim attachment point attached to the trim element on a second side of the opening, the second side being on an opposite side of the opening from the first side, wherein the tray attachment member transfers the weight of the first household appliance to the second household appliance such that the first and second household appliances are attached in a vertically oriented free standing relationship.

16. The assembly according to claim 15, wherein the base tray includes walls defining a receiving space that receives the first household appliance.

17. The assembly according to claim 16, wherein the trim element opening permits movement through the trim element opening of a door of the first household appliance during opening and closing of the door.

18. The assembly according to claim 17, wherein the floor portion of the base tray is vertically lower than an upper edge of a first part of the trim element, such that the first part of the trim element hides the floor portion from view when the first household appliance is in position on the floor portion.

19. The assembly according to claim 18, wherein the tray attachment member supports the base tray at a vertical spacing above the second household appliance.

20. The assembly according to claim 15, wherein the tray attachment member supports the base tray at a vertical spacing above the second household appliance.

21. The appliance assembly according to claim 15, wherein a single assembled unit including the trim element, the base tray, the tray attachment member, and the trim securing member is removable from the second household appliance as a single unit.

* * * * *